US005295850A

United States Patent [19]

Jeffcoat et al.

[11] Patent Number: 5,295,850

[45] Date of Patent: Mar. 22, 1994

[54] FUSE HOLDER WITH FUSE RELEASE

[75] Inventors: Walter L. Jeffcoat, Vidalia; Wendell D. Copeland, Lyons, both of Ga.

[73] Assignee: Challenger Electrical Materials, Inc., Malvern, Pa.

[21] Appl. No.: 47,898

[22] Filed: Apr. 19, 1993

[51] Int. Cl.[5] ..... H01R 13/00

[52] U.S. Cl. ..... 439/266; 439/832

[58] Field of Search ..... 439/259-270, 439/830-833

[56] References Cited

U.S. PATENT DOCUMENTS

| | | | |
|---|---|---|---|
| 2,199,793 | 5/1940 | Hammerly | 439/832 |
| 2,325,697 | 8/1943 | Millermaster et al. | 439/832 |
| 2,665,415 | 1/1954 | Kojis | 439/832 |

*Primary Examiner*—Joseph H. McGlynn

*Attorney, Agent, or Firm*—M. J. Moran

[57] ABSTRACT

The tensioned jaws of a fuse clip are spread by a rotating a pin that rests in a slot in each of the jaws. The pin has opposed flat surfaces that define a position at which the jaws are not spread. The pin has a flange that rests in the slots, holding the pin in a fixed orientation.

6 Claims, 1 Drawing Sheet

FUSE HOLDER WITH FUSE RELEASE

TECHNICAL FIELD

This invention relates to fuse holders, in particular techniques for releasing fuses in fuse holders.

BACKGROUND OF THE INVENTION

Cartridge fuses are used in many applications. The fuse typically is cylindrical with two flat spade terminals at opposite ends. The terminals are intended to slide into fuse clips that conduct current through the fuse. The fuse clips are defined by spring loaded or tensioned jaws that tightly grasp the terminals, holding the fuse securely in place. The size of these fuses can be considerable and the spring tension from the clip is commensurately high, meaning that considerable force may be needed to remove the fuse. The clips serve as terminals to the fuse and are attached to a base on the power control box, often mounted on a wall. The box may contain a power lever that is rotated to connect one fuse terminal to the "hot" input. A contact, usually hinged to the terminal, is rotated by the lever, forcing a spade terminal on the contact into a pair of clips that are connected to the hot power input.

DISCLOSURE OF THE INVENTION

An object of the present invention is to provide an improved way to remove large cartridge fuses from fuse clips.

According to the present invention, a mechanism is permanently installed between the jaws of the fuse clips that can be manually operated to release the jaw tension.

According to the present invention, a pin or "controllable releaser" is located between the fuse clip walls. The pin rests in opposed vertical seats or slots in each of the jaws. The pin, accessible from a location above the clip, is retained in the seat, where it can be rotated. The pin has an eccentric shape and when it is rotated it spreads the clip, removing some of the pressure of the spring on the fuse terminal, allowing the fuse terminal to be easily removed.

According to one aspect of the invention, the pin has a flat surface that engages the clips when the jaws are fully closed. Acting as detent, this provides a clear demarcation between the "clip open" and "clip closed" configurations, minimizing the chances that a fuse will be installed without rotating the pin so the clip is securely pressing against the terminal. The pin may be slotted so that it can be rotated with a conventional driver.

Among the features of the present invention is that it takes up very little space and may be easily incorporated in the manufacture of a standard fuse clip. Other features and benefits of the invention will be apparent to one skilled in the art from the following description.

BEST MODE FOR CARRYING OUT THE INVENTION

Figure 1:
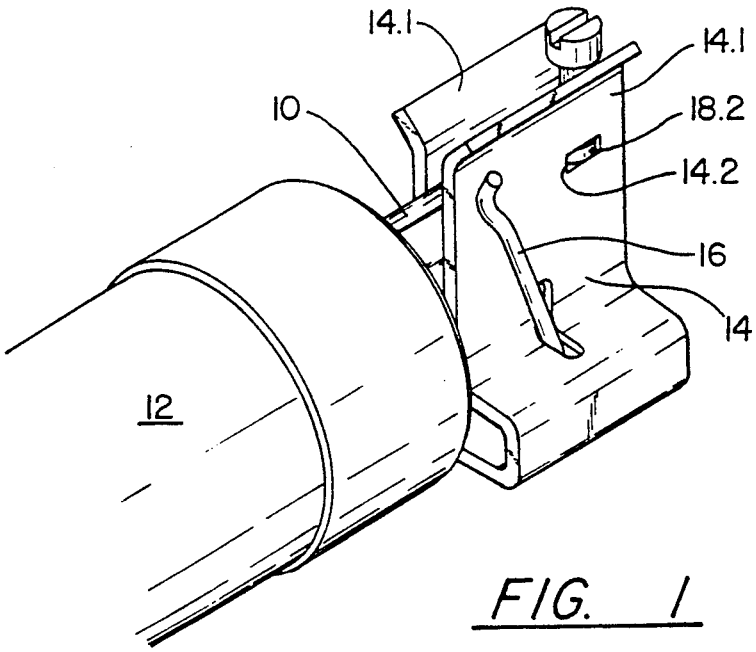
FIG. 1, a perspective, shows a portion of typical cartridge fuse with one of its spade or flat terminals in a clip constructed from a pair of jaws with a release according to the present invention.
Figure 2:
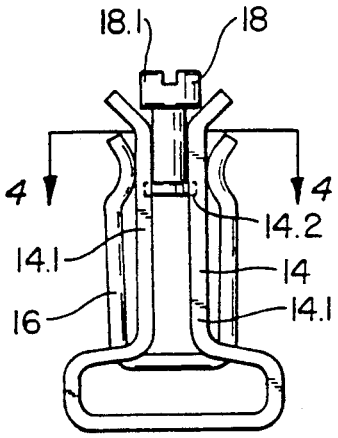
FIG. 2 is an elevation of the clip with the release pin in a first of two possible positions, with the jaws unextended.
Figure 3:
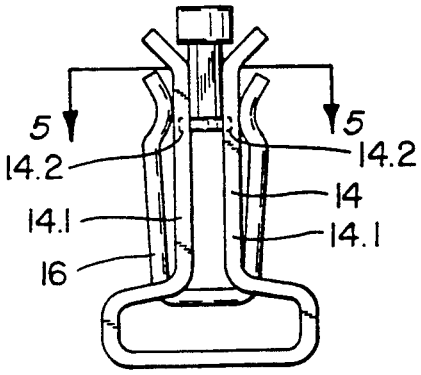
FIG. 3 is an elevation of the clip with the release pin in a second of two possible positions, with the jaws extended.

Referring to FIG. 1, a flat spade-like terminal 10 on one end of a typical cartridge fuse 12 is located between two jaws 14.1 that are part of a fuse clip. A spring 16 aids in forcing the two jaws 14.1 together, applying considerable force on the terminal 12, making it difficult to remove the terminal from the clip.

Figure 4:
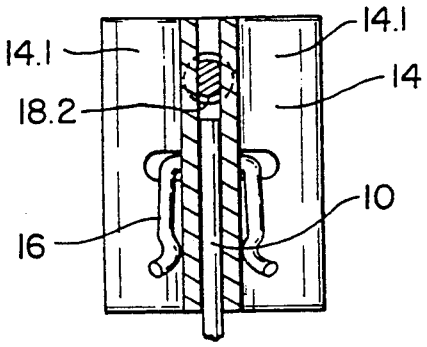
FIG. 4 is a plan view along line 4—4 in FIG. 2.
Figure 5:
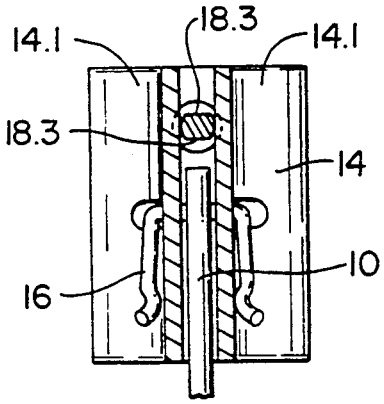
FIG. 5 is a plan view along line 5—5 in FIG. 3.

A releasing pin 18 is located between the jaws 14.1. This is turned to open the jaws, easing the removal of the terminal from the clip. The pin 18 has a slotted head 18.1 and a flange 18.2 at the opposite end. The flange, it will be seen, rests in two opposed horizontal slots (guides) 14.2 in the clip. The "fit" between the flange and the slot is such that the flange maintains the pin in an upright position between the jaws. The pin has an eccentric crosssection (see FIGS. 4 and 5); specifically, it has two opposed flat surfaces 18.3 (best seen in FIG. 5), giving it a two stage diameter in effect. With the narrower diameter separating the jaws 14.1, the clip 14 is in a sense closed, as illustrated in FIG. 4. With the wider diameter located between the jaws, the jaws are separated, as illustrated in FIG. 5. The two positions are attained by rotating the, but it should be appreciated that the flat surface will provide positive tactile feedback that the jaws are closed. For this reason, a flat surface is desirable, although an eccentric diameter can be attained with other configurations.

With the aid of the previous discussion of the invention, one skilled in the art may be able to make modifications and variations to the invention, in whole or in part, in addition to any described above, without departing from the true scope and spirit of the invention.

We claim:

1. A fuse holder comprising a pair of opposed jaws tensioned to receive a fuse terminal, characterized by:

means rotatably mounted between the jaws and accessible from a position above the jaws to spread the jaws to a first separation distance from a second separation distance.

2. A fuse holder according to claim 1, further characterized in that the means has a discrete position associated with the second distance.

3. A fuse holder according to claim 2, further characterized in that the means has a flat surface that is disposed between the jaws when the jaws are at the second distance.

4. A fuse holder according to claim 3, further characterized in that the means comprises a rotational guide that engages a rotational guide on each jaw to maintain the guide means in a fixed vertical orientation between the jaws.

5. A fuse holder according to claim 4, further characterized in that the means comprises a pin extending outward from a location between the jaws with opposed flat surfaces that engage the jaws as the pin is rotated, the pin having at one end a flange and the jaws having opposed slots receiving the flange.

6. A fuse holder comprising a pair of opposed jaws tensioned to receive a fuse terminal, characterized by:

means rotatably mounted between the jaws and accessible from a position above the jaws to spread the jaws to a first separation distance from a second separation distance, the means comprising a pin extending outward from a location between the jaws with opposed flat surfaces that engage the jaws as the pin is rotated, the pin having at one end a flange and the jaws having opposed slots receiving the flange.

* * * * *